US008256337B2

(12) United States Patent
Hill et al.

(10) Patent No.: US 8,256,337 B2
(45) Date of Patent: Sep. 4, 2012

(54) MODULAR INITIATOR

(75) Inventors: Freeman L. Hill, Houston, TX (US); Randy L. Evans, Sugar Land, TX (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 12/044,384

(22) Filed: Mar. 7, 2008

(65) Prior Publication Data

US 2009/0223400 A1 Sep. 10, 2009

(51) Int. Cl.
*E21B 43/116* (2006.01)

(52) U.S. Cl. ..... 89/1.15

(58) Field of Classification Search ..... 102/275.2, 102/275.4, 275.7, 310, 304, 275.3, 275.11, 102/275.8, 206, 202.1, 202.9; 89/1.15, 1.151
See application file for complete search history.

(56) References Cited

U.S. PATENT DOCUMENTS 1,599,078 A * 9/1926 Corrie ..... 102/275.9
2,674,945 A * 4/1954 Marsh ..... 102/202.12
4,383,484 A * 5/1983 Morrey ..... 102/275.3
4,752,089 A * 6/1988 Carter ..... 285/276
4,762,067 A * 8/1988 Barker et al. ..... 102/313
5,027,708 A * 7/1991 Gonzalez et al. ..... 102/254
5,088,413 A 2/1992 Huber et al.
5,179,250 A * 1/1993 Campoli ..... 102/443
5,518,072 A * 5/1996 McTernaghan ..... 166/115
5,603,379 A * 2/1997 Henke et al. ..... 166/297
5,756,926 A 5/1998 Bonbrake et al.
5,992,523 A * 11/1999 Burleson et al. ..... 166/297
6,098,716 A * 8/2000 Hromas et al. ..... 166/377
6,283,227 B1 9/2001 Lerche et al.
6,604,584 B2 8/2003 Lerche et al.
7,231,982 B2 * 6/2007 Sloan et al. ..... 166/378
7,360,487 B2 * 4/2008 Myers et al. ..... 102/275.12
2007/0095572 A1 5/2007 Harvey et al.

* cited by examiner

*Primary Examiner* — Michael Carone
*Assistant Examiner* — Reginald Tillman, Jr.
(74) *Attorney, Agent, or Firm* — Bracewell & Giuliani LLP

(57) ABSTRACT

An initiator for initiating detonation in a detonation cord of a perforating system, where the initiator comprises a modular electronic igniter that quick connects into a portion of high explosive. The high explosive is disposed in a housing having an end of detonation cord crimped therein. The electronic igniter may be shipped to the field and/or stored separate from the high explosive then the two may be assembled just prior to deploying the perforating gun assembly in a wellbore. Various methods of quick connecting the electronic igniter to the high explosive may be used.

19 Claims, 3 Drawing Sheets

Ax
30
30a
32
34
34a
35
36
37
38
39
40
42
42a
44
45
46
47
48
49
50
51
52
53
54
56
73
74
75

MODULAR INITIATOR

BACKGROUND

1. Field of Invention

The invention relates generally to the field of oil and gas production. More specifically, the present invention relates to a perforating system. Yet more specifically, the present invention relates to a modular initiator for use in a perforating gun system.

2. Description of Prior Art

Perforating systems are used for the purpose, among others, of making hydraulic communication passages, called perforations, in wellbores drilled through earth formations so that predetermined zones of the earth formations can be hydraulically connected to the wellbore. Perforations are needed because wellbores are typically completed by coaxially inserting a pipe or casing into the wellbore. The casing is retained in the wellbore by pumping cement into the annular space between the wellbore and the casing. The cemented casing is provided in the wellbore for the specific purpose of hydraulically isolating from each other the various earth formations penetrated by the wellbore.

Perforating systems typically comprise one or more perforating guns strung together, these strings of guns can sometimes surpass a thousand feet of perforating length. In FIG. 1 an example of a perforating system 4 is shown. For the sake of clarity, the system 4 depicted comprises a single perforating gun 6 instead of a multitude of guns. The gun 6 is shown disposed within a wellbore 1 on a wireline 5. The perforating system 4 as shown also includes a service truck 7 on the surface 9, where in addition to providing a raising and lowering means, the wireline 5 also provides communication and control connectivity between the truck 7 and the perforating gun 6. The wireline 5 is threaded through pulleys 3 supported above the wellbore 1. As is known, derricks, slips and other similar systems may be used in lieu of a surface truck for inserting and retrieving the perforating system into and from a wellbore. Moreover, perforating systems may also be disposed into a wellbore via tubing, drill pipe, slick line, coiled tubing, to mention a few.

Included with the perforating gun 6 are shaped charges 8 that typically include a housing, a liner, and a quantity of high explosive inserted between the liner and the housing. When the shaped charge high explosive is detonated, the force of the detonation collapses the liner and ejects it from one end of the charge 8 at very high velocity in a pattern called a "jet" 12. The jet 12 perforates the casing and the cement and creates a perforation 10 that extends into the surrounding formation 2.

The shaped charges 8 are typically connected to a detonating cord, which when detonated creates a compressive pressure wave along its length that initiates shaped charge detonation. An initiator 14 is typically used to set off detonation within the detonation cord. FIG. 2 provides a side cross sectional view of a typical initiator 14 having leads (16, 17) secured in an end cap 20 of the initiator 14 and connected on their lower terminal ends via a frangible bridge 18. The initiator 14 is typically controlled at surface where an electrical signal is sent via the wireline 5 to one of the leads (16, 17). In the example of FIG. 2 current from the electrical signal flows from lead 17 to lead 16 through the frangible bridge 18. The bridge 18 is made from a conductive material and includes generally a narrowed portion that heats and disintegrates under the applied current load. An amount of high explosive 22 is disposed in a housing 24 adjacent the frangible bridge 18 which is ignitable in response to the energy dissipated during the frangible bridge 18 disintegration. An end of a detonation cord 26 is positioned adjacent the lower end of the high explosive 22 and may be crimped 28 into place. Combustion of the high explosive 22 is readily transferred to the adjacent detonation cord 26 which detonates the cord 26 that in turn detonates the shaped charges 8.

Generally the initiators are connected to the perforating cords in the field just prior to use. Thus they are shipped to the field with the electrical portions and high explosive coupled together in a single unit. Because of the risks posed by the high explosives and the threat of a transient electrical signal, shipment and storage of the initiators is highly regulated, this is especially so when being shipped to foreign locations. Additional problems may be encountered in the field when connecting initiators to the detonation cord. Perforating guns when delivered to the field generally have the shaped charges and detonation cord installed; to facilitate initiator connection some extra length of detonation cord is provided within the gun. Connecting the initiator to the detonation cord involves retrieving the free end of the detonation and cutting it to a desired length then connecting, usually by crimping, the initiator to the detonation cord. These final steps can be problematic during inclement weather. Additionally, these final steps fully load a perforating gun and thus pose a threat to personnel in the vicinity. Accordingly benefits may be realized by reducing shipping and storage concerns, increasing technician safety, and minimizing the time required to finalize gun assembly in the field.

SUMMARY OF INVENTION

Disclosed herein is a perforating gun initiator comprising, a first housing, a high explosive within the first housing, a detonation cord disposed proximate the high explosive, and an electronic igniter in a second housing selectively quick coupled with the high explosive. The electronic igniter comprises an explosion initiating bridge element. An electrical signal source may be included in communication with the bridge element for providing a signal for initiating detonation of the high explosive. In one embodiment, the electronic igniter comprises an end cap, electrical contact leads axially extending through the end cap, a bridge element connected between the contact leads; and an annular insert extending from the end cap. A bore may be provided in the high explosive for receiving the annular insert therein. A quick connect assembly may optionally be employed for providing quick coupling engagement between the electronic igniter and the high explosive. An embodiment of the quick connect assembly comprises an upper portion and a lower portion, each of which affixable to one of the electronic igniter or high explosive, snap members extending from the upper portion, and receptacles formed in the lower portion formed to receive the snap members. The quick connect assembly may also optionally comprise an overshot skirt extending from the outer radius of the electronic igniter formed to quick connect with a collar on the high explosive. The perforating quick connect assembly may also optionally comprise a series of hooks and loops. In another embodiment, the quick connect assembly comprises a corresponding lip and groove on one of the annular insert outer surface and bore inner surface.

Also disclosed herein is an initiator for use in igniting a detonation cord of a perforating system, the initiator comprising, high explosive in a housing, detonating cord in explosive communication with the high explosive; an explosion initiating frangible bridge member coupled to the high explosive; wherein the bridge member is in electronic communication with a detonation signal; and a quick connect assembly affixed between the bridge member and the high explosive.

The present disclosure also includes method of forming a perforating system comprising, connecting a detonation cord to a shaped charge disposed in a perforating gun, positioning a high explosive into detonating proximity with the detonation cord, quick connecting an electronic igniter to the high explosive, where the electronic igniter comprises a frangible bridge member, and connecting the frangible bridge member to a detonating signal source. The electronic igniter of this method may comprise electrical leads in electrical communication via the frangible bridge member, and end cap having passages therethrough in which the leads are positioned. The further optionally comprises disposing the perforating gun within a wellbore, lowering the perforating gun proximate to a location to be perforated, supplying an electrical detonation signal to the bridge member thereby disintegrating the bridge member to create a source of ignition of the high explosive. Alternatively included with the present method is a step of assembling the perforating system at an assembly site and separately shipping to the assembly site the high explosive and electronic igniter.

BRIEF DESCRIPTION OF DRAWINGS

Some of the features and benefits of the present invention having been stated, others will become apparent as the description proceeds when taken in conjunction with the accompanying drawings, in which.

Figure 2:
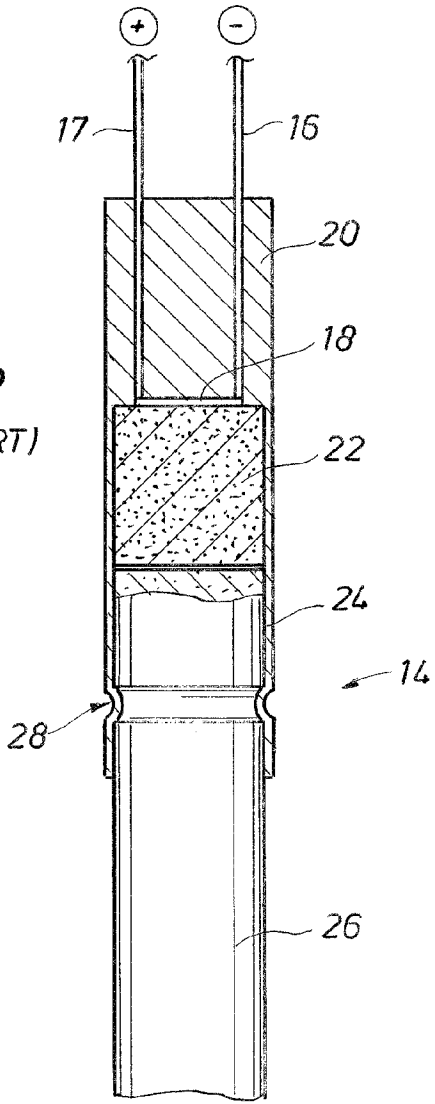
FIG. 2 (PRIOR ART)
FIG. 2 illustrates a cutaway side view of a prior art perforating gun initiator.
Figure 1:
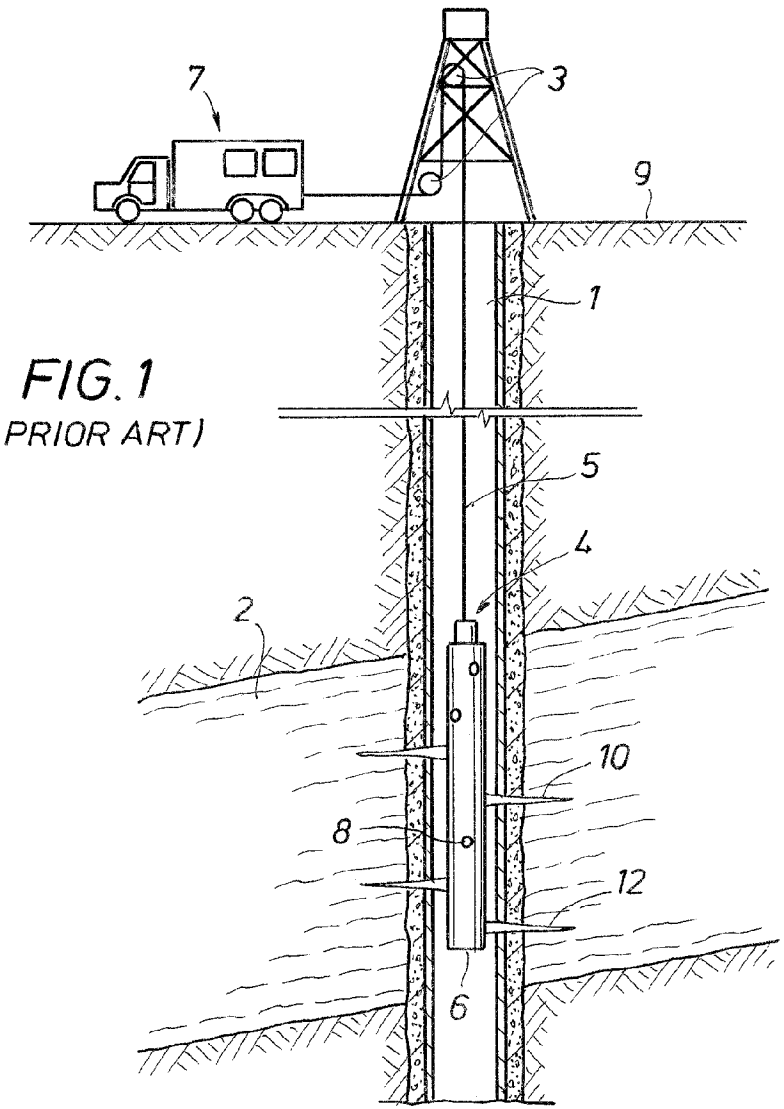
FIG. 1 (PRIOR ART)
FIG. 1 is partial cutaway side view of a prior art perforating system in a wellbore.

While the invention will be described in connection with the preferred embodiments, it will be understood that it is not intended to limit the invention to that embodiment. On the contrary, it is intended to cover all alternatives, modifications, and equivalents, as may be included within the spirit and scope of the invention as defined by the appended claims.

DETAILED DESCRIPTION OF INVENTION

The present invention will now be described more fully hereinafter with reference to the accompanying drawings in which embodiments of the invention are shown. This invention may, however, be embodied in many different forms and should not be construed as limited to the illustrated embodiments set forth herein; rather, these embodiments are provided so that this disclosure will be thorough and complete, and will fully convey the scope of the invention to those skilled in the art. Like numbers refer to like elements throughout. For the convenience in referring to the accompanying figures, directional terms are used for reference and illustration only. For example, the directional terms such as "upper", "lower", "above", "below", and the like are being used to illustrate a relational location.

It is to be understood that the invention is not limited to the exact details of construction, operation, exact materials, or embodiments shown and described, as modifications and equivalents will be apparent to one skilled in the art. In the drawings and specification, there have been disclosed illustrative embodiments of the invention and, although specific terms are employed, they are used in a generic and descriptive sense only and not for the purpose of limitation. Accordingly, the invention is therefore to be limited only by the scope of the appended claims.

The disclosure herein is directed to an initiator for use in initiating the detonation of a detonation cord used in a perforating gun system. The initiator described herein comprises an electronic portion and a high explosive portion. The electronic and high explosive portions are both modular elements that are distinct and separate from one another, but can be quickly connected during assembly or makeup of a perforating gun system. The separate and modular characteristic of these elements allows these portions of the initiator to be shipped and stored separate from one another. Separate shipping and storage significantly reduces the issues encountered due to domestic and foreign regulations regarding high explosives. Also enhanced is the safety of assembling a perforating gun system using the initiator as described herein.

Figures 3, 4, 5A:
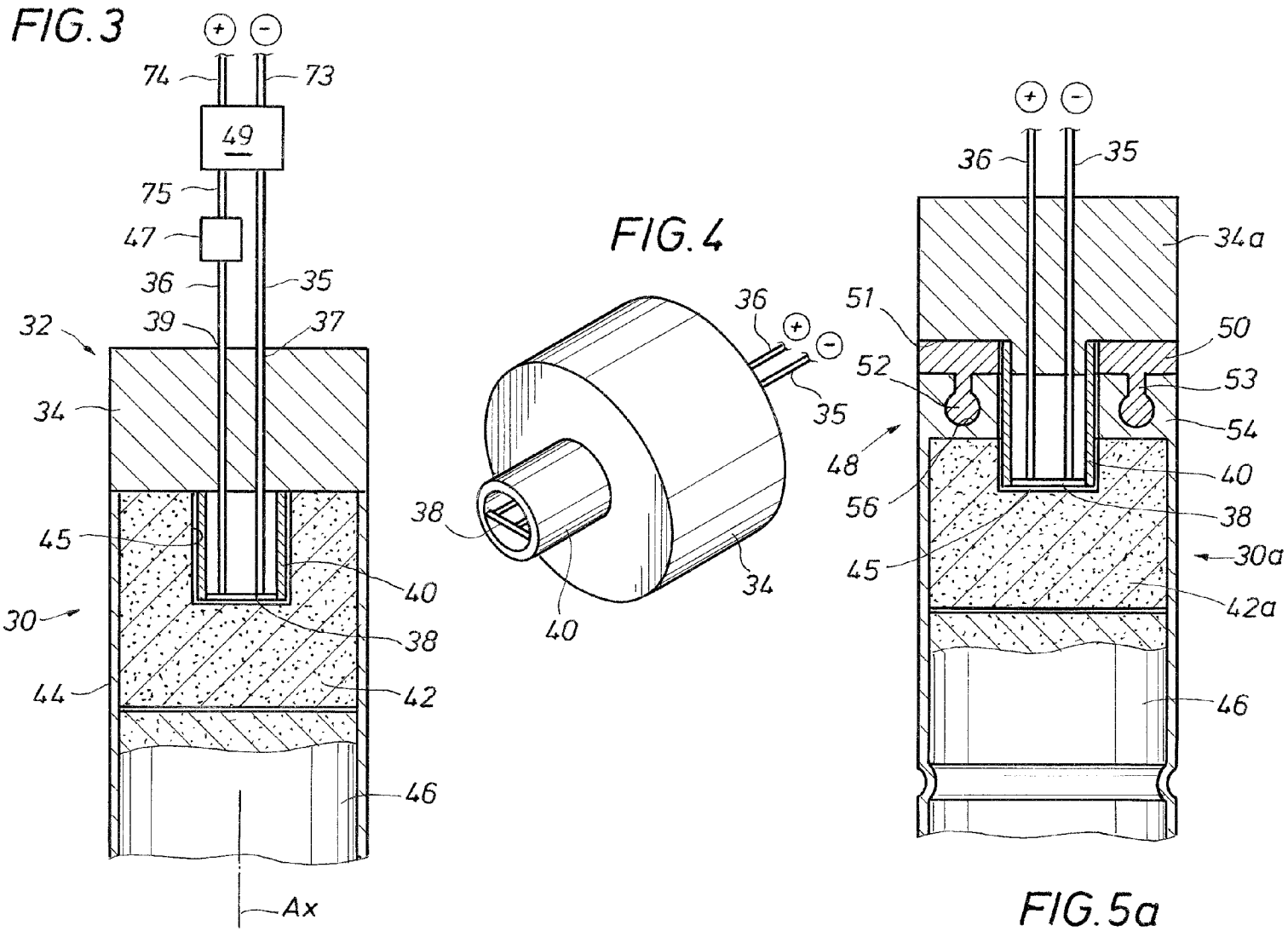
FIG. 3 is a side cutaway view of an embodiment of an initiator.
FIG. 4 is a side perspective view of an embodiment of a portion of the initiator of FIG. 3.
FIGS. 5*a*-5*d* are side cutaway views of embodiments of initiators and coupling devices.

FIG. 3 represents a side cross sectional view of an embodiment of an initiator assembly 30 having the novel features as described herein. The initiator assembly 30 comprises an electronic igniter 32 shown connected to a portion of high explosive 42, where the high explosive 42 is formed within a housing 44. The electronic igniter 32 comprises an end cap 34 having a generally cylindrical configuration with its lower planar surface generally aligned with the upper planar surface of the high explosive 42. A bore 45 extends from the high explosive 42 upper planar surface and runs generally coaxial with the axis $A_x$ of the initiator assembly 30. The bore 45 is formed to receive an annual insert 40 which extends from the end cap 32 lower planer surface.

A frangible bridge element 38 (or bridge member) is shown disposed proximate to the lower terminal end of the insert 40, the bridge element 38 is disposed generally perpendicular to the axis $A_x$ of the initiator assembly 30. Electrical leads (35, 36) are electrically connected to the bridge element 38 and respectively on distal ends of the bridge element 38 proximate to the inner wall of the insert 40. The leads (35, 36) extend upward and perpendicular from the bridge element 38 and through the end cap 34 via passages (37, 39) formed to receive the leads (35, 36) therethrough. The upper ends of the leads (35, 36) are in electrical communication with a signal source (not shown) for delivering an explosive signal through the leads to the bridge element 38.

The modular aspect of the electronic igniter 32 and the configuration of the explosive 42 within its housing 44 allow these two members to be quickly connected together in a quick connect operation, just prior to fully assembling a perforating system for deployment into a well bore and used in initiating detonation of an associated detonation cord 46 for perforating a well bore.

FIG. 4 provides a perspective view of one embodiment of the electronic igniter 32. In this view, the insert 40 shown as a generally annular member having a bridge element 38 extending along the opening at the terminal end of the insert 40. The end cap 34 receives the upper end of the insert where the insert is affixed therein. Although the bridge element 38 is shown as an elongated member with a substantially consistent cross sectional area, it can tale on many different forms. The bridge element 38 however should be formed from an electrically conducting material disintegratable with an appropriate amount of electrical current flowing therethrough. Moreover, the disintegrative effect of the bridge element 38 should be sufficient to initiate high explosive 42 detonation. It is believed that it is well within the capabilities of those skilled in the art to form an appropriately dimensioned bridge element and apply a proper amount of electrical current therethrough to produce an explosion initiating bridge element for initiating high explosive detonation.

Schematically provided in FIG. 3 is an optional communication module 49 for controlling electrical power from upper lead 74 to the electronic initiator 32 and to an upper lead 73 from the electronic initiator 32. In one example, the communication module 49 forms an open circuit between the upper lead 74 and an intermediate lead 75 thus preventing power from reaching the electronic initiator 32. The communication module 49 is configured to respond to receiving a pre-designated signal or sequence of signals via the upper lead 74 by closing an internal circuit thereby providing electrical communication between the upper lead 74 and the intermediate lead 75. The pre-designated signal may be sent from a controller or operator at the surface, and include an identifier or address recognizable by the communications module 49. The communications module 49 may also be configured to acknowledge the pre-designated signal and respond with a signal indicating the acknowledgement. The acknowledgement reflects receipt of the pre-designated signal and may note the communications module 49 has switched into a closed circuit thereby allowing electrical power to be transmitted to the electrical initiator 32. Electrical power for activating the initiator assembly 30 may be provided with or subsequent to the pre-designated signal (also referred to as an arming signal) or may be sent after the acknowledgement signal has been received.

Proper disintegration of the bridge element 38 typically requires a threshold voltage which often exceeds the voltage provided via the lead 35 or the associated wireline. Thus a step up module 47 may optionally be provided for attaining the threshold voltage. Thus in one mode of operation of the initiator assembly 30 of FIG. 3, the step up module 47 increases the voltage the electrical power it receives from the communications module 49 via the intermediate lead 75 to at least the threshold voltage. Optionally, as shown in FIG. 3, space may exist between the bridge element 38 and explosive 42.

Various embodiments of quick connection assemblies are provided in FIGS. 5*a* through 5*d*. However, any manner of coupling the modular electronic igniter to a high explosive for use in forming a perforating system detonation initiator can be employed with the present device. For the purposes of discussion herein a quick connection or quick connection assembly, means forming a connection between two members by urging the two members together with an opposing force. Optionally, quick connection can also mean bringing any two elements together with opposing force and rotating one or both of the members, the rotation preferably is less than 360°.

In the quick connect embodiment shown in FIG. 5*a*, a coupling 48 affixes the electronic igniter 34*a* to an amount of explosive 42*a*. The coupling 48 comprises an upper portion 50 disposed within an annular groove 51 where the groove 51 is formed on the lower outer periphery of the end cap 34*a*. The upper portion 50 includes a downwardly extending snap member 52 whose cross sectional area varies along its length. In the embodiment shown the snap member 52 is a generally spherical member connected to the upper portion 50 via a base portion 53. The coupling 48 further comprises an annular lower portion 54 affixed on the upper planar surface of the high explosive 42*a*, wherein the lower portion 54 circumscribes a portion of the insert 40 that extends into the bore 45 of the explosive 42*a*. Receptacles 56 are shown provided within the lower portion 54 configured to receive the snap members 52 therein. Preferably, the corresponding diameters of the snap members 52 and receptacles 56 are substantially the same such that an urging force is required to insert the snap members 52 within their receptacles 56. This results in a press fit allowing for a quick connect between the electronic igniter 34*a* and the explosive 42*a*. The press fit can not only be quick connected, but also retains the modular units together into a single cohesive initiator suitable for use in initiating detonation of an associated detonation cord 46.

Figure 5D:
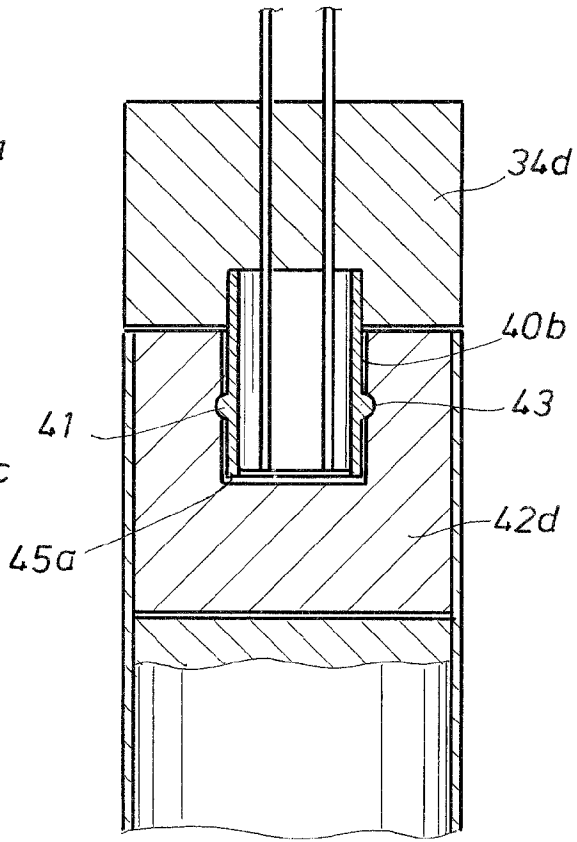
Figure 5C:
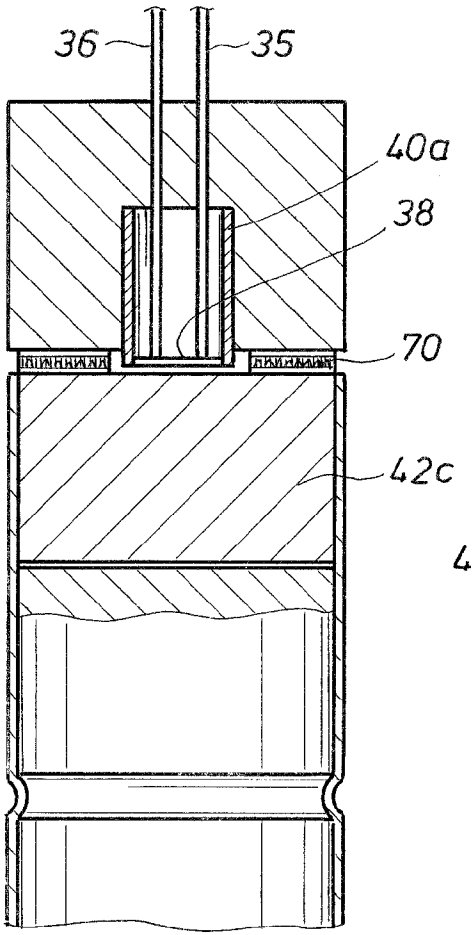
Figure 5B:
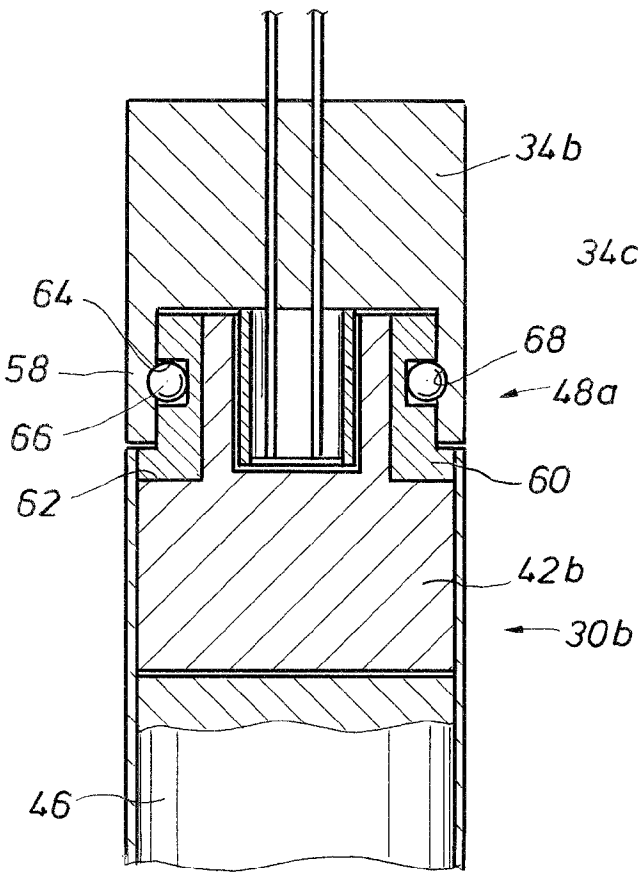

An optional embodiment of a coupling 48*a* is provided in side cross sectional view in FIG. 5*b*. In this embodiment the coupling 48*a* comprises an annular overshot skirt 58 which extends from the outer periphery of the end cap 34*b* downward. A groove 62 is formed on the outer surface of the upper end of the high explosive 42, a ring like collar 60 resides on the outer circumference of the groove 62. The collar 60 is generally coaxial with the overshot skirt 58 and has an outer diameter substantially the same as the inner diameter of the overshot skirt 58. Accordingly, downward sliding of the overshot skirt 58 over the collar 60 can quickly connect the electronic initiator 34*b* to the high explosive 42*b*. Optionally small ball bearings 66 may be included in receptacle wells 64 formed in the collar 60. Corresponding indentations 68 may be formed on the inner surface of the overshot skirt 58 and formed for mating cooperation with the ball bearing 66.

As shown in side cross sectional view in FIG. 5*c* a quick connection assembly for coupling an electronic initiator 34*c* to a high explosive 42*c* may comprise a series of opposingly formed hooks and loops 70 wherein a series of hooks may be glued or otherwise secured to the bottom planar surface of the electronic igniter 34*c* and corresponding loops glued or otherwise secured to the upper most surface of the high explosive 42*c*. In partial cross sectional view, FIG. 5*d* illustrates a lip and groove arrangement for quick connecting an electronic initiator 34*d* to high explosive 42*d*. Here a lip 41 is formed on the outer surface of the insert 40*b* extending downward from the end cap 43*d*. A corresponding groove 43 is formed within the bore 45*a* and configured to provide a press fit and quick connection coupling between the electronic igniter and the high explosive 42*d*.

The present invention described herein, therefore, is well adapted to carry out the objects and attain the ends and advantages mentioned, as well as others inherent therein. While a presently preferred embodiment of the invention has been given for purposes of disclosure, numerous changes exist in the details of procedures for accomplishing the desired results. These and other similar modifications will readily suggest themselves to those skilled in the art, and are intended to be encompassed within the spirit of the present invention disclosed herein and the scope of the appended claims.

What is claimed is:

1. A perforating gun initiator comprising:

a housing;

an amount of explosive disposed in the housing and proximate to an end of a detonating cord;

an explosive free modular electronic initiator comprising;

electrically conducting leads and disintegratable bridge wire for initiating high explosive detonation when a designated electrical current is applied through the leads;

a coupling for selectively connecting the housing and electronic initiator so that when the housing and electronic initiator are connected by the coupling and the designated electrical current applied through the leads, the exploding bridge wire initiates detonation of the explosive; and a space between the exploding bridge wire and the explosive when the housing and electronic initiator are connected by the coupling.

2. The perforating gun initiator of claim 1, wherein the explosive is disposed within a perforating gun and the electronic initiator is outside and separate from the explosive when the electronic initiator is in a shipping configuration.

3. The perforating gun initiator of claim 1 further comprising a bore formed in the explosive.

4. The perforating gun initiator of claim 3 wherein the electronic initiator further comprises an end cap, where the electrical contact leads axially extending through the end cap; and an annular insert extending from the end cap, the annular insert housing the bridge element and a portion of the contact leads, wherein the bore is configured to receive therein the annular insert.

5. The perforating gun initiator of claim 1, wherein the coupling comprises a quick connect assembly in coupling engagement between the electronic igniter and the explosive.

6. The perforating gun initiator of claim 5 wherein the quick connect assembly comprises an upper portion and a lower portion, each of which are affixable to one of the electronic igniter or explosive, snap members extending from the upper portion, and receptacles formed in the lower portion formed to receive the snap members.

7. The perforating gun initiator of claim 5, further comprising a collar on the outer circumference of the explosive, ball bearings set in a groove on the outer surface of the collar, an overshot skirt extending from the outer radius of the electronic igniter having indentations on an inner lateral surface, so that when the collar is inserted into the overshot skirt, the overshot skirt circumscribes the collar.

8. The perforating gun initiator of claim 5 wherein the quick connect assembly comprises a series of hooks and loops.

9. The perforating gun initiator of claim 5, further comprising an annular insert extending from the electronic igniter, a bore in the explosive formed to receive the annular insert therein, and wherein the quick connect assembly comprises a corresponding lip and groove on one of the annular insert outer surface and bore inner surface.

10. A perforating system comprising:

a perforating gun having a shipping configuration, an assembled configuration, and a deployed configuration;

a shaped charge disposed in the gun; and an initiator comprising:

explosive in a housing coupled to a detonating cord that is in explosive communication with the shaped charge;

a modular electrical igniter separate from the explosive and outside the perforating gun when the perforating gun is in the shipping configuration and coupled to the explosive when the perforating gun is in the assembled configuration and the deployed configuration, a disintegratable bridge wire connected to electrical leads for igniting the explosive when a designated electrical current is applied to the electrical leads, and a space between the disintegratable bridge wire and explosive when in the assembled configuration; and a connector for selectively attaching the electrical igniter to the housing so the exploding bridge wire is facing the explosive when the perforating gun is in the assembled configuration and the igniter is attached to the housing.

11. The perforating system of claim 10 wherein the electronic igniter contains no explosive.

12. The perforating system of claim 10, further comprising a quick connect assembly having a snap member mechanically coupled with the bridge member, and a receptacle affixed to the explosive, wherein the receptacle is formed to receive the snap member therein and form a quick connect therebetween.

13. The perforating system of claim 12, wherein the quick connect assembly comprises an overshot skirt mechanically coupled with the bridge member and circumscribing a portion of the bridge member, a collar formed to quick connect with the overshot inner circumference, and a groove formed on the outer surface of the explosive formed to receive the collar thereon.

14. A method of perforating in a wellbore comprising:

providing a perforating system comprising a perforating gun, shaped charges in the perforating gun, and a detonating cord in explosive communication with the shaped charges;

providing an amount of explosive in a housing to define an explosive portion of an initiator, so that when the explosive is ignited while disposed adjacent the detonating cord, a detonation wave is formed in the detonation cord;

providing an electronic portion of an initiator comprising an exploding bridge connected to electrical leads and a connector for selectively attaching the electronic portion to the explosive portion;

separately shipping the electronic portion and the explosive portion to the wellbore;

releasably connecting the electronic portion to the explosive portion so that the exploding bridge is spaced apart and proximate to the explosive; and delivering an electrical detonating signal through the electrical lead to the bridge member to initiate detonation of the explosive thereby detonating the detonating cord and detonating the shaped charges.

15. The method of claim 14 wherein the step of separately shipping the electronic portion and explosive portion enables shipping and storage without regulation.

16. The method of claim 14 further comprising disposing the perforating gun within a wellbore, lowering the perforating gun proximate to a location to be perforated prior to supplying the electrical detonation signal to the bridge member thereby disintegrating the bridge member to create a source of ignition of the explosive.

17. The method of claim 14, wherein the perforating system is assembled at an assembly site, and the explosive and electronic igniter are separately shipped to the assembly site.

18. The perforating gun initiator of claim 1, wherein the outer periphery of the modular initiator is substantially the same as the outer periphery of the housing.

19. The perforating gun initiator of claim 1, further comprising a communication module in electrical communication between the electrically conducting leads and wherein the electrically conducting leads, communication module, and modular initiator form a portion of a circuit, so that when a signal is sent to the communication module through one of the electrically conducting leads, the communication module selectively opens or closes the circuit.

* * * * *